US006237898B1

(12) United States Patent
Lafont

(10) Patent No.: US 6,237,898 B1
(45) Date of Patent: May 29, 2001

(54) DEVICE FOR STIRRING THE CONTENT OF A TANK COMPRISING A BUBBLE ELEVATOR

(75) Inventor: Jacques Lafont, Montpellier (FR)

(73) Assignee: Commissariat a l'Energie Atomique, Paris (FR)

( * ) Notice: Subject to any disclaimer, the term of this patent is extended or adjusted under 35 U.S.C. 154(b) by 0 days.

(21) Appl. No.: 09/355,618

(22) PCT Filed: Feb. 24, 1998

(86) PCT No.: PCT/FR98/00359

§ 371 Date: Aug. 18, 1999

§ 102(e) Date: Aug. 18, 1999

(87) PCT Pub. No.: WO98/37956

PCT Pub. Date: Sep. 3, 1998

(30) Foreign Application Priority Data

Feb. 28, 1997 (FR) ..... 97 02427

(51) Int. Cl.[7] ..... B01F 3/04
(52) U.S. Cl. ..... 261/77; 210/221.2; 261/123
(58) Field of Search ..... 261/77, 123, 29, 261/36.1; 210/220, 221.2

(56) References Cited

U.S. PATENT DOCUMENTS

| | | | | |
|---|---|---|---|---|
| 1,936,308 | * | 11/1933 | Mueller | 261/123 |
| 3,840,216 | | 10/1974 | Smith et al. | 261/29 |
| 3,953,003 | * | 4/1976 | Mahig | 261/77 X |
| 4,187,263 | | 2/1980 | Lipert | 261/77 |
| 4,436,675 | * | 3/1984 | Hisao et al. | 210/220 X |
| 4,439,316 | * | 3/1984 | Kozima et al. | 210/220 X |
| 4,569,757 | * | 2/1986 | Moore | 210/220 |
| 4,569,804 | * | 2/1986 | Murphy | 210/221.2 X |
| 4,789,503 | * | 12/1988 | Murphy | 261/77 |
| 4,911,838 | * | 3/1990 | Tanaka | 210/221.2 |
| 5,755,976 | * | 5/1998 | Kortmann | 261/77 X |
| 6,017,020 | * | 1/2000 | Baughman et al. | 261/36.1 |

FOREIGN PATENT DOCUMENTS

| | | | | |
|---|---|---|---|---|
| 41531 | * | 1/1933 | (FR) | 261/123 |
| 1527186 | * | 12/1989 | (SU) | 261/123 |

* cited by examiner

*Primary Examiner*—Richard L. Chiesa
(74) *Attorney, Agent, or Firm*—Burns Doane Swecker & Mathis LLP

(57) ABSTRACT

The bubble elevator includes an orifice intermediate between the air tapping point for entraining liquid and the top opening for ejecting the air/liquid mixture. The liquid can be ejected through the orifice when the tank has a low liquid level and its content cannot therefore be entrained as far as the top, or on the other hand an additional suction of liquid can be produced. A bubble elevator is generally used to stir and homogenize the liquid content of a tank.

6 Claims, 3 Drawing Sheets

DEVICE FOR STIRRING THE CONTENT OF A TANK COMPRISING A BUBBLE ELEVATOR

This application is the U.S. National Phase of International Application No. PCT/FR98/00359 filed on Feb. 24, 1998.

FIELD OF THE INVENTION

The invention concerns a device for stirring the content of a tank.

BACKGROUND OF THE INVENTION AND BRIEF DESCRIPTION OF THE RELATED ART

It uses an appliance already employed for this purpose and in normal use notably in the nuclear industry: it is referred to as a bubble elevator and consists of a generally vertical tube, open at its ends, which also comprises an air-inlet tapping at an intermediate height. The bottom end is always immersed in the liquid in the tank and corresponds to a liquid entry opening, whilst the top end can be emerging or immersed according to circumstances and corresponds to an opening for ejecting a mixture of air and liquid: this is because the air introduced into the tube through the tapping rises, entraining with it the liquid occupying the tube, until it emerges through the top end, and the ejected liquid is replaced by liquid from the tank entering through the bottom opening. Bubble elevators do not require the use of moving mechanical parts and can therefore be employed even in corrosive liquids; they are very effective for stirring and homogenising the liquid in the tanks, notably in order to put back in suspension any deposits which have accumulated at the bottom of the tank.

The efficiency of a bubble elevator can be defined as the flow of entrained liquid divided by the flow of air supplied. It is found that it is very variable and depends greatly on the degree of immersion, that is to say on the ratio between the height separating the air tapping from the level of liquid in the tank and the height, which is invariable, between the air tapping and the top of the elevator; the first of these heights corresponds in reality to the difference in level between the air tapping and the free surface of the liquid. If the liquid is flush with the top of the elevator, the latter is entirely immersed and the degree of immersion is 100%; this degree decreases as the liquid drops in the tank. It is found that the efficiency drops rapidly with the degree of immersion and that it becomes zero for a degree of immersion equal to approximately ⅓, which means that the liquid no longer emerges at all from the top opening of the elevator. It must therefore be accepted that bubble elevators become inoperative for tanks with a low level of liquid. When the level in the tank is variable, several elevators of different heights are arranged and used separately according to circumstances, choosing the one which for the time being will have the best efficiency or the one which will open out at depths which will afford the most complete homogenisation. However, it is correct to judge that the installation becomes complicated.

SUMMARY OF THE INVENTION

The subject of the invention is an improved bubble elevator which offers both good efficiency and a possibility of auxiliary operation in tanks with a low liquid level. It can replace several ordinary elevators.

This bubble elevator comprises a tube open at a lower liquid entry end, at a top end for ejecting a gas and liquid mixture and at a gas injection tapping at a height intermediate between the ends, and is distinguished in that the tube also comprises at least one additional opening at an intermediate height between the top end and the air injection tapping. This new opening can serve to suck in an additional flow of liquid in certain circumstances or on the other hand to eject the mixture. A tube is generally connected to this opening.

BRIEF DESCRIPTION OF THE DRAWINGS

The invention will now be described in detail with the help of the following figures, attached for illustrative and non-limitative purposes.

DETAILED DESCRIPTION OF THE PREFERRED EMBODIMENTS

Figure 1:
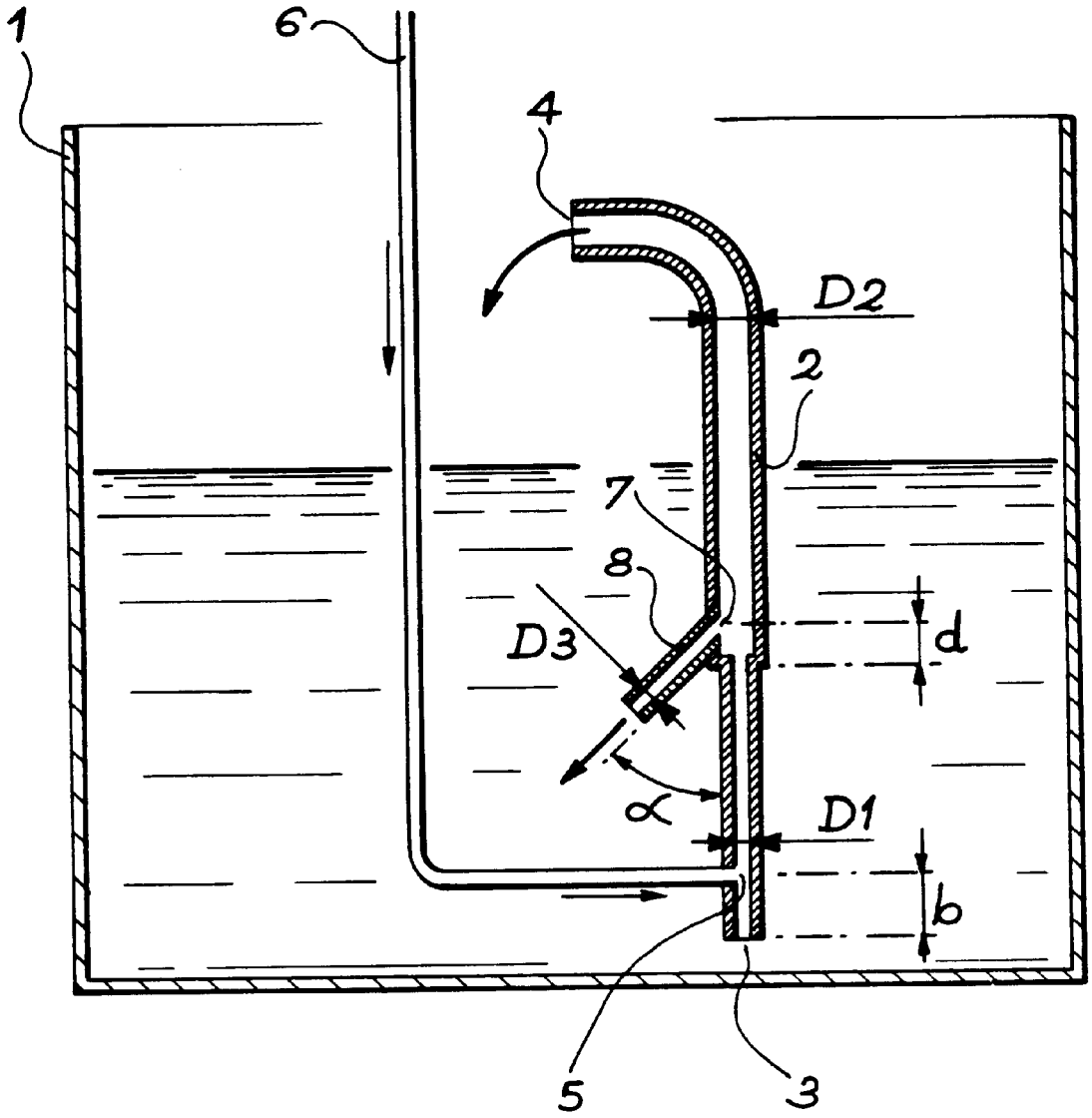
FIG. 1 depicts a bubble elevator according to the invention.

The bubble elevator of FIG. 1 is shown housed in a tank 1 and comprises a main tube 2 open at its bottom end 3 and at its top end 4 where, as is usual, it is curved in the form of a crook in order to eject the mixture of elevator gas and liquid entrained horizontally or even downwards. An intermediate opening corresponding to the air tapping 5 is formed at a short height from the bottom end 3; a compressed-air conduit 6 is connected thereto, which supplies the mixing gas.

The essential element of the invention consists of an additional opening 7 in the main tube 2, situated between the tapping 5 and the top end 4 and to which it is possible to connect a connecting tube 8 which extends from there horizontally or downwards, and opens into the tank 1 below the top end 4.

It will be seen that the connecting tube 8 lends itself equally well to the suction of liquid from the tank and to the ejection of a mixture. It is good to mention first certain geometric characteristics of the elevator and to explain their advantage. Thus the main tube broadens towards the top, changing from a diameter D1 at the bottom end 3 to a greater diameter D2 at the top end 4. The change in diameter is located a little below the connecting opening 7 and is abrupt, but in correct operation would be obtained with a progressive variation in diameter over a small height of the main tube 2. This arrangement is useful for sucking in liquid through the connecting tube 8, since it was found that a smooth main tube with a constant inside diameter was subjected to a uniform flow which would not make it possible to obtain a high additional flow through the connecting opening 7, whilst the main tube 2 described here is the cause of turbulence which promotes a suction of liquid through the connection tube 8. The difference in level d between the section where the diameter changes from D1 to D2, where the turbulence is produced, and the connecting opening 7, must be as small as possible, perhaps a few centimetres; the suction effect would be reduced or compromised if it were too great.

Moreover, additional tests, performed with a view to optimising and reducing the value of the difference in level b between the bottom end 3 and the air tapping 30 opening 5, have shown that the empirical values recommended in the devices of the prior art, situated in a range of values of between 15 and 25 cm, in order to prevent any risk of escape of air downwards through the bottom 3, which would reduce the performance of the elevator, could be greatly reduced.

It is possible to give to the difference in level b a value of approximately 5 cm for a main tube 2, without finding any escape of air, even in increasing the rate of injection through the tapping 5 until it is tripled. This possibility of reducing the difference in level b is beneficial since it increases the degree of immersion of the elevator, all other things being equal, and therefore the range of its operation in tanks with a low level of liquid, since the degree of immersion corresponding to stopping of functioning remains ⅓. Even when functioning is possible with a high air tapping 5, its lowering increases the efficiency of the elevator.

The diameter D3 of the connecting tube 8, its angle of inclination and its length are determined empirically. The diameter D3 must be smaller than the diameter D2, and the length less than that of the bottom part (of diameter D1 of the main tube 2.

Figure 2A:
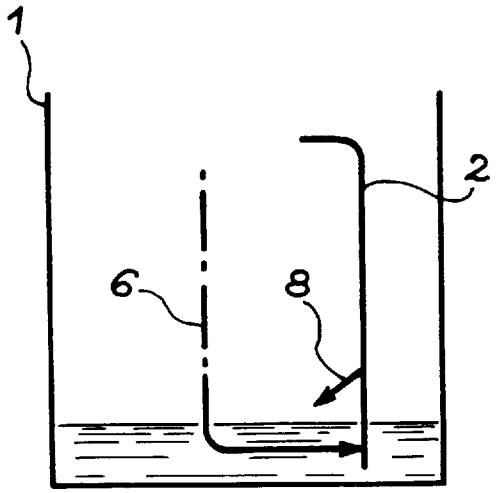
FIGS. 2*a* to 2*d* illustrate several operating methods which can be distinguished.

FIG. 2*a* illustrates a situation where the tank bottom is almost empty but where a homogenisation of its content is all the same sought. The air is supplied at the required rate and entrains the liquid present at the bottom of the tube 2 as far as the connecting opening 7 before discharging it through the connecting tube 8: a functioning of the "first stage" of the elevator, which concerns only its bottom part, is therefore obtained, whilst the remainder, lying between the connecting opening 7 and the top end 4, consist of a "second stage" which remains entirely empty for this operating mode apart from a leakage of air, since its immersion is too small.

Figure 2B:
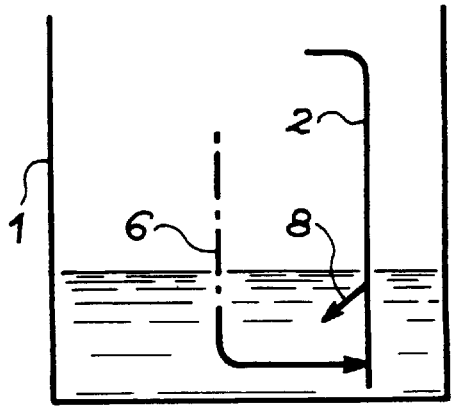

If the tank fills, the state in FIG. 2*b* can be arrived at, where the liquid level extends as far as the connecting opening 7: this functioning remains approximately the same as before, all the air and liquid mixture passing through the connecting tube 8, except that the mixture is ejected directly into the liquid.

Figure 2C:
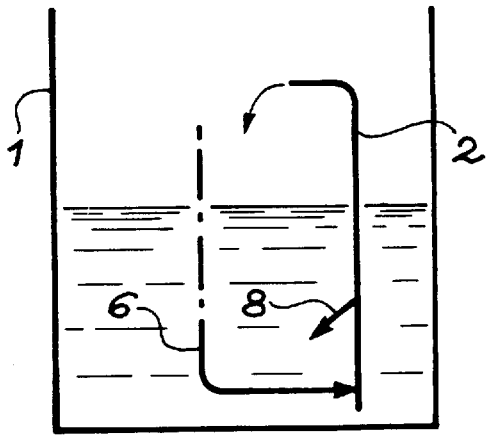

If the tank 1 continues to fill, the state in FIG. 2*c* is arrived at, where the second ejection stage possibly becomes active. If the flow of air injected remains relatively low, all the liquid sucked in is sent into the tank through the connecting tube 8 as before. However, if the air flow is increased, the flow of liquid injected increases also and an increasing part, which rapidly becomes preponderant, passes through the second stage and leaves the elevator through the top end 4, as in an ordinary elevator. The division of the mixture between the two stages can assist the homogenisation of the liquid by virtue of the stirring produced at several heights.

Figure 2D:
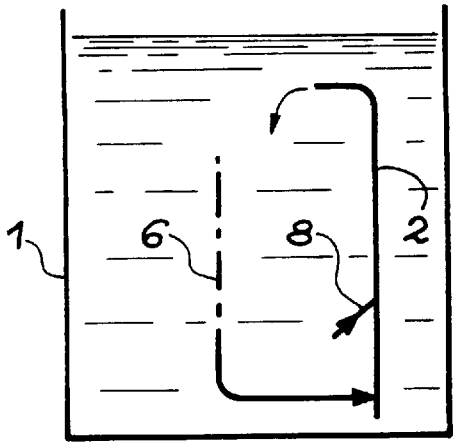

If the level of the liquid in the tank rises still further, FIG. 2*d* is arrived at, where the functioning of the elevator changes once again: the circulation of fluid reverses in the connecting tube 8, which becomes a suction tube with an additional liquid flow. The suction of the liquid at two heights further assists a high degree of stirring of the content of the tank, at the same time as an increase in the flow of liquid entrained in the main tube 2. The connecting opening 7 then optimises the functioning of the bubble elevator by making it possible to suck in and then eject a greater flow of liquid than in an ordinary elevator, for an identical air flow.

Figure 3:
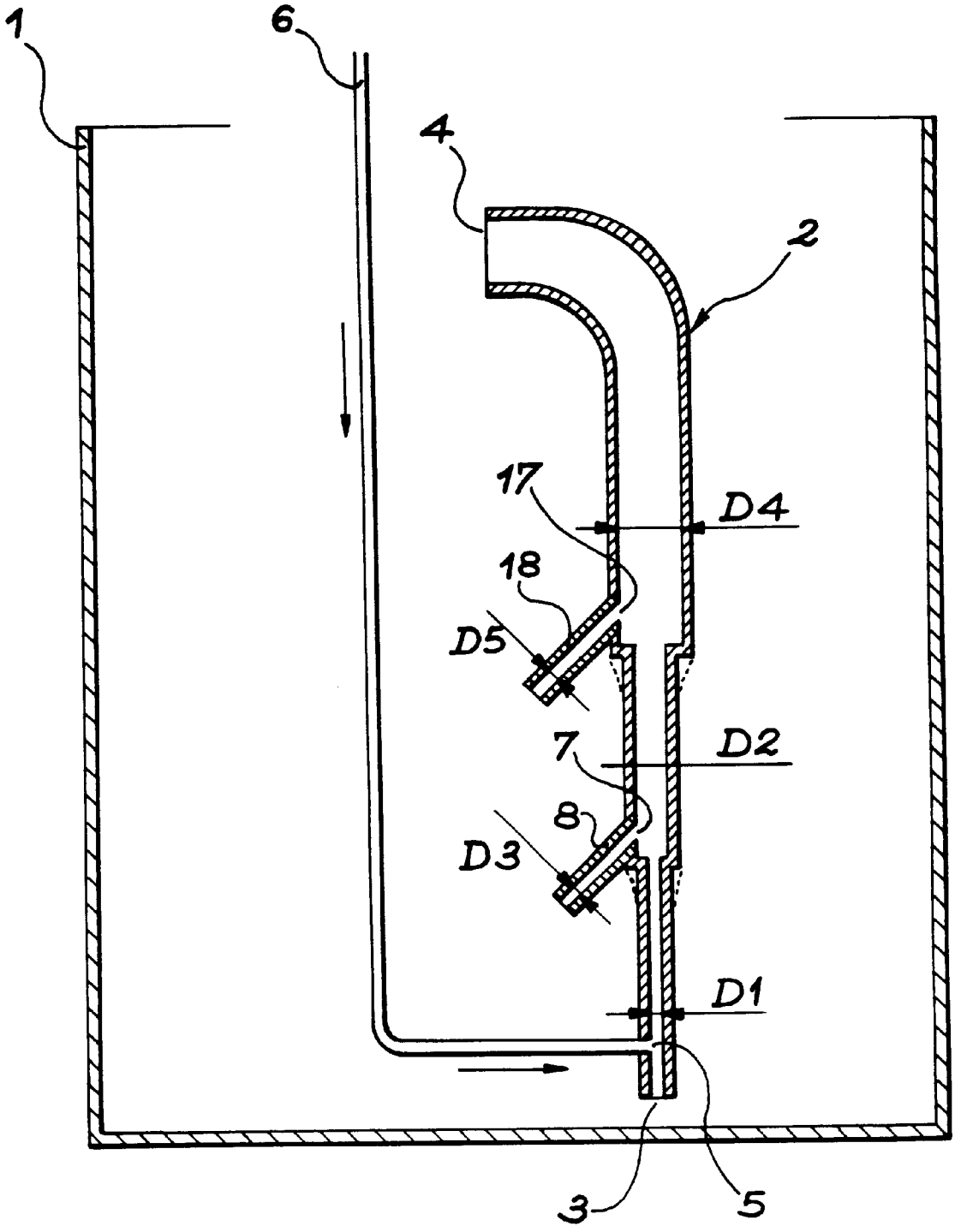
FIG. 3 depicts another bubble elevator.

FIG. 3 shows that the concept of intermediate orifice can be extended to a bubble elevator with more than two ejection stages: the elevator illustrated therein thus has a second intermediate orifice 17 above the first (referenced 7 as in the previous example), and the second connecting tube 18 is connected thereto. It is in a descending slope towards the tank 1 as previously, and its diameter D5 can be similar to the diameter D3 of the first connecting tube 8 or a little greater. The tube 2 then comprises three sections, with diameters D1, D2 and D4, which are connected 7 and 17 with abrupt or progressive changes in diameter as before. The mixture of air and liquid emerges from the elevator 7 and 17 or through the top end 4 of the tube 2, or several of these points at the same time according to the immersion and air flow, as before.

What is claimed is:

1. A device for stirring the liquid content of a tank, comprising at least one bubble elevator comprising a tube (2) open at a bottom liquid-entry end (3) and at a top end (4) for ejecting a mixture of liquid and gas, and a tapping (5) for injecting air at a height intermediate between the ends, characterised in that the tube (2) also comprises an additional opening (7) at a height intermediate between the top end and the air injection tapping and through which the liquid can be sucked into the tube or be ejected therefrom.

2. A device for stirring the content of a tank according to claim 1, characterised in that the tube is composed of a bottom portion finishing a little below the additional opening and a top portion with a larger diameter (D2) than the bottom portion.

3. A device for stirring the content of a tank according to claim 2, characterised in that the portions of the tube are connected at an abrupt change in diameter.

4. A device for stirring the content of a tank according to claim 2, characterised in that the portions of the tube are connected at a progressive change in diameter.

5. A device for stirring the content of a tank according to claim 1, characterised in that a connecting tube (8) is connected to the tube (2) at the additional opening (7), the connecting tube opening out below the top end (4).

6. A device for stirring the content of a tank according to claim 1, characterised by at least one second additional opening (17) at a height intermediate between the top end (4) of the tube (2) and the air injection tapping (5), the intermediate openings (7, 17) being at different heights.

* * * * *